US007485785B1

(12) United States Patent
Steinberger

(10) Patent No.: US 7,485,785 B1
(45) Date of Patent: Feb. 3, 2009

(54) POSITIONING AID FOR STRINGED MUSICAL INSTRUMENT

(76) Inventor: Richard Ned Steinberger, 420 Hill Top Rd., Nobleboro, ME (US) 04555

( * ) Notice: Subject to any disclaimer, the term of this patent is extended or adjusted under 35 U.S.C. 154(b) by 282 days.

(21) Appl. No.: 11/545,972

(22) Filed: Oct. 10, 2006

(51) Int. Cl.
*G10D 3/00* (2006.01)

(52) U.S. Cl. ..... 84/327

(58) Field of Classification Search ..... 84/453, 84/327, 329, 431, 321
See application file for complete search history.

(56) References Cited

U.S. PATENT DOCUMENTS 4,770,079 A * 9/1988 Mastroianni ..... 84/291

* cited by examiner

*Primary Examiner*—Kimberly R Lockett
(74) *Attorney, Agent, or Firm*—Saul Epstein

(57) ABSTRACT

A positioning aid for a stringed musical instrument of the lute family that includes a pair of arms frictionally attached to the instrument and adapted to fit diagonally across the front of a player's body, in such a way so as to maintain the attitude of the instrument with respect to the body without the instrument being held.

7 Claims, 4 Drawing Sheets

FIG 3
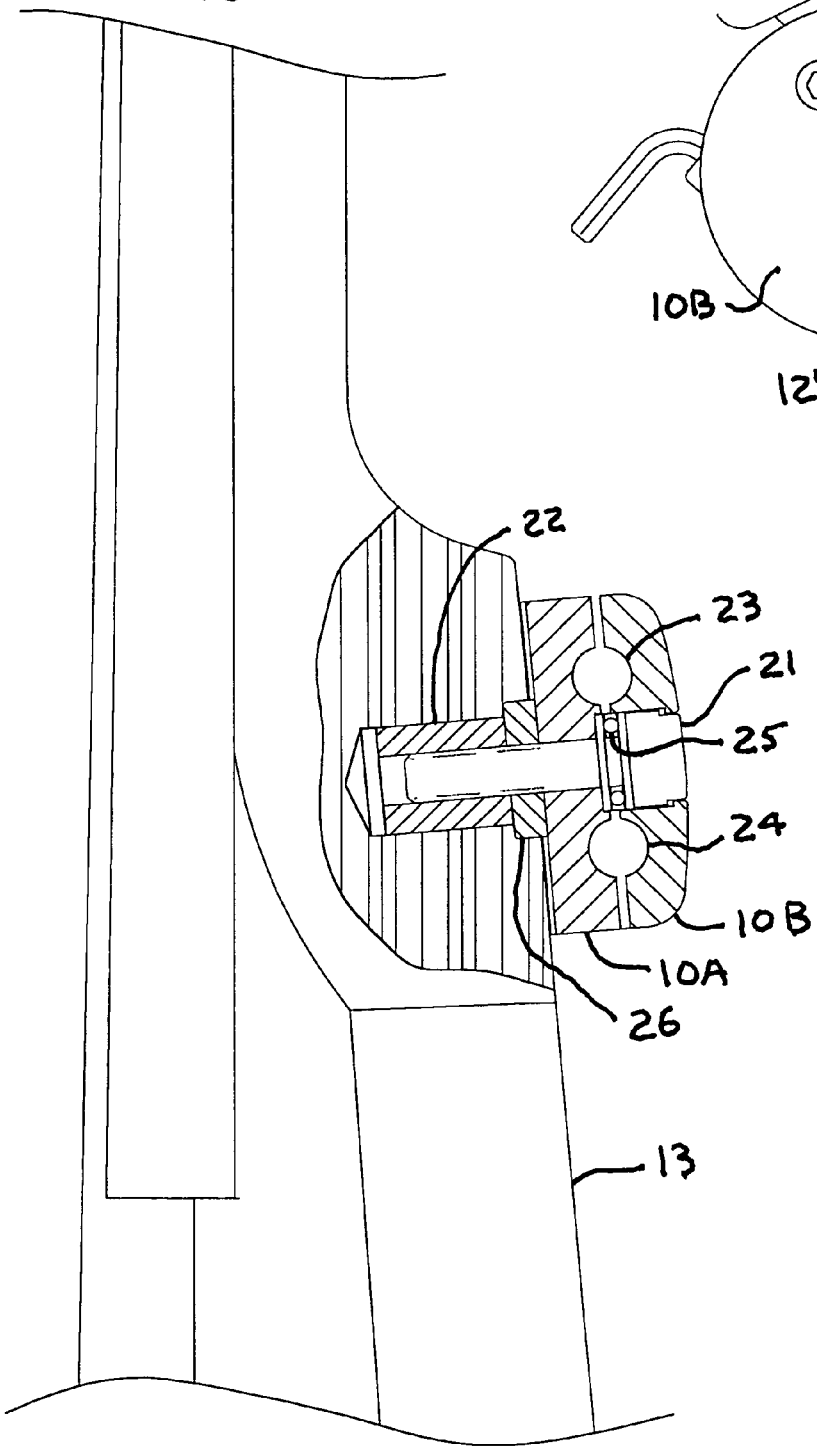
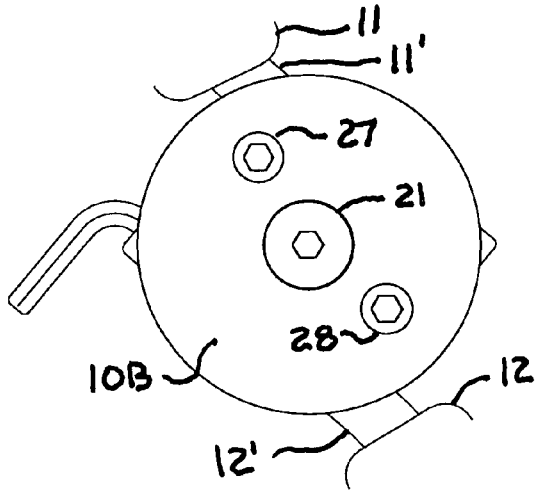
FIG 4

POSITIONING AID FOR STRINGED MUSICAL INSTRUMENT

BACKGROUND OF THE INVENTION

This invention is intended as an accessory for certain stringed musical instruments of the lute family. In particular, it is intended as an attachment for a lute of the type wherein the player holds the instrument in front of his or her body, and strums or plucks the strings. The invention is described in connection with a bass cello, but it will be appreciated that it is applicable to many other instruments as well, for example, basses, guitars, etc.

Stringed instruments of the type described can, of course, be played either right or left handed, but in the discussion that follows only right handed operation is mentioned. Left handed operation would generally be opposite, as will be understood.

Conventionally, stringed musical instruments of the type mentioned are positioned with the instrument body approximately adjacent to the player's right hip, and are supported by a strap passing over the player's left shoulder, the strap ends being fastened to the tail and the neck of the instrument. Instrument support in this manner is relatively unstable. Accordingly, some portion of the player's attention and physical attributes must be devoted to simply holding the instrument in the desired position to be played. The present invention reduces that burden on the player.

SUMMARY OF THE INVENTION

In the invented positioning aid, a pair of curved arms are rotationally coupled to a hub attached to the instrument body, such that after suitable adjustment, the arms are positioned to approximately fit the curvature of the player's body while the instrument is in position to be played. The arms preferably extend diagonally across and in front of the player's body from about his or her waist to below his or her breast. The arms are held against the body by a conventional strap over the shoulder, and maintain the instrument position relative to the player's body without its having to be held. The attitude of the instrument may easily be changed by the player while being played (by simply pushing on the neck), and the instrument will automatically maintain its new position.

Typically, instruments such as a bass cello, are played while being held by the player at an angle to the floor, with the junction of the neck and the instrument body located at or slightly above hip level on the right side of the player's body. The hub of the present invention is preferably attached to the body of the instrument near the intersection of the instrument body and neck. A pair of curved arms (called, for convenience, a short arm and a long arm) are rotationally attached to the hub. In use, the short arm curves partially around the player's waist, while the long arm extends partially across the player's body upward toward the player's left shoulder, preferably terminating below the breast. A conventional guitar strap passes over the left shoulder, and is attached to the ends of the arms.

The curved arms, held by the strap, maintain a substantially fixed position with respect to the player's body during a performance, and friction between the hub and the instrument causes the instrument to maintain a fixed position with respect to the hub. The instrument, therefore, will maintain a substantially fixed position with respect to the player's body during the performance unless the player intentionally overcomes the hub/instrument body friction, thereby changing the instrument attitude.

Provision is made for the arms to rotate with respect to the hub so that the arms can be placed in a compact position with respect to the instrument body for convenient storage of the instrument.

BRIEF DESCRIPTION OF THE DRAWINGS

FIG. 3 is a side enlarged sectional view of the hub as mounted on an instrument, the arms being removed for clarity and the body of the instrument partially sectioned.

FIG. 4 is a plan view of the hub.

DETAILED DESCRIPTION OF THE INVENTION

Figure 1:
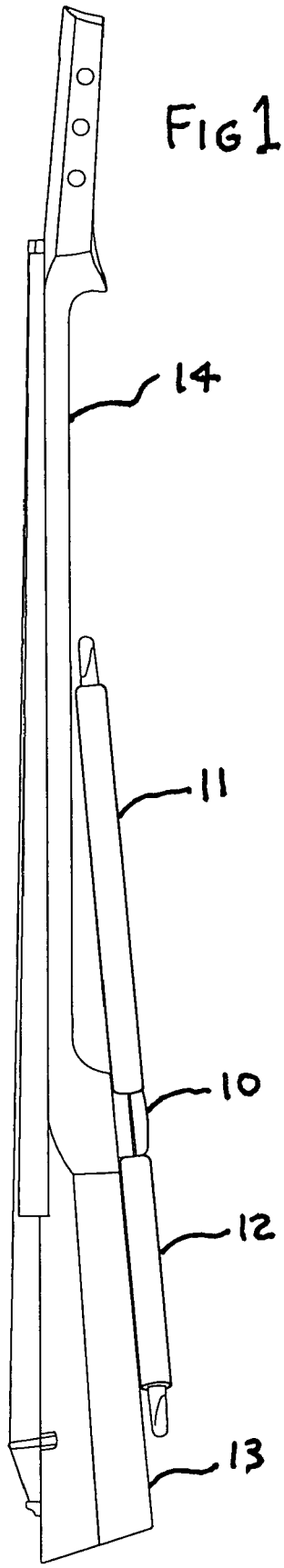
FIG. 1 is a side view of a bass cello with one embodiment of the invented positioning aid attached to the back of the body thereof. The invention is shown in its storage configuration.
Figure 2:
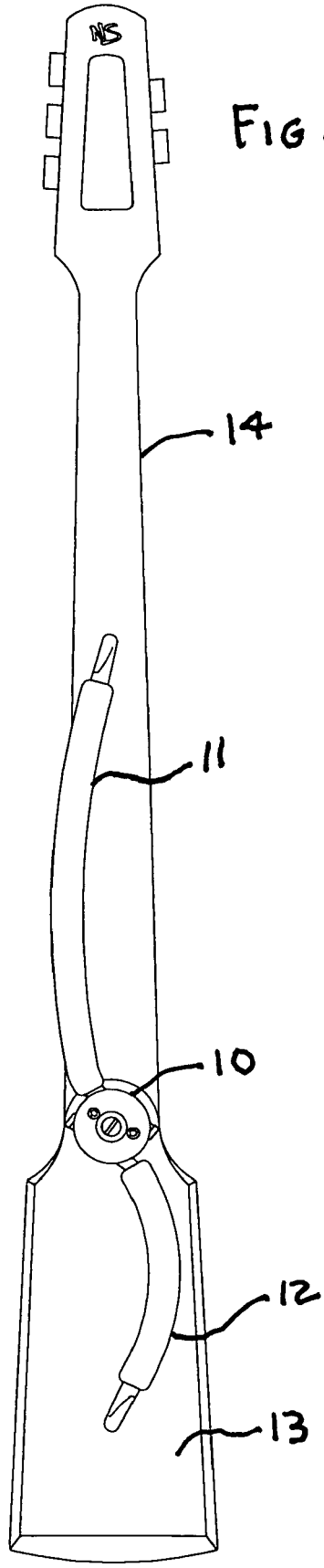
FIG. 2 is a rear view of the bass cello of FIG. 1.

FIGS. 1 and 2 depict side and rear views of one embodiment of the invention attached to a bass cello (the instrument). As seen in FIGS. 1 and 2, the invention is configured for storage. The arms are folded flat against the instrument body and neck so that a minimum volume is presented. Views of the instrument of FIGS. 1 and 2 with the arms unfolded for use may be seen in FIGS. 8 and 9.

The invention is comprised of three major elements, a rotatable hub 10, a long arm 11, and a short arm 12. The hub is fastened to the instrument body 13, preferably near the region where the body joins the neck 14. Arms 11 and 12 are held in substantially parallel holes, 23 and 24, that pass through the hub preferably substantially normal to the hub axis of rotation (which axis is preferably approximately normal to the rear face of the body).

The arms 11 and 12 are curved (except for the portions thereof that are held in the holes in the hub, i.e., "the straight ends"), each curve preferably lying substantially in a single plane, which plane includes the straight ends. The curvatures of the arms is preferably such that the arms will fit comfortably against and approximately conform to the player's body shape when in use.

FIG. 3 is a fragmentary side view of the instrument partially sectioned to show the installation of the hub 10. The hub is retained by screw 21 threaded into pressed in bushing 22. The hub 10 itself is comprised of two halves, 10A and 10B and includes two transverse holes 23 and 24, through which the straight ends of the arms 11 and 12 extend (arms not shown in FIG. 3). A thrust ball bearing 25 is preferably placed under the head of screw 21 so that as the hub 10 is rotated (as will be discussed later), the screw will not loosen or tighten. Tightening screw 21 increases the force of hub 10 against friction thrust washer 26, increasing the resistance to rotation of the hub with respect to the body 13 of the instrument.

FIG. 4 is a plan view of the hub 10, portion 10B being visible. The heads of screws 27 and 28 may be seen in this figure. These screws extend between hub portions 10A and 10B, allowing the turning friction of the straight ends 11' and 12' of arms 11 and 12 (with respect to the transverse holes 23 and 24) to be adjusted. It is preferred that the screws 27 and 28 be positioned closer to straight end 11' than straight end 12' so that in use, the arm 11 will be harder to turn than arm 12. In any event, screws 21, 27 and 28 may be adjusted by the user to make any of the turning joints as stiff as desired.

Figure 5:
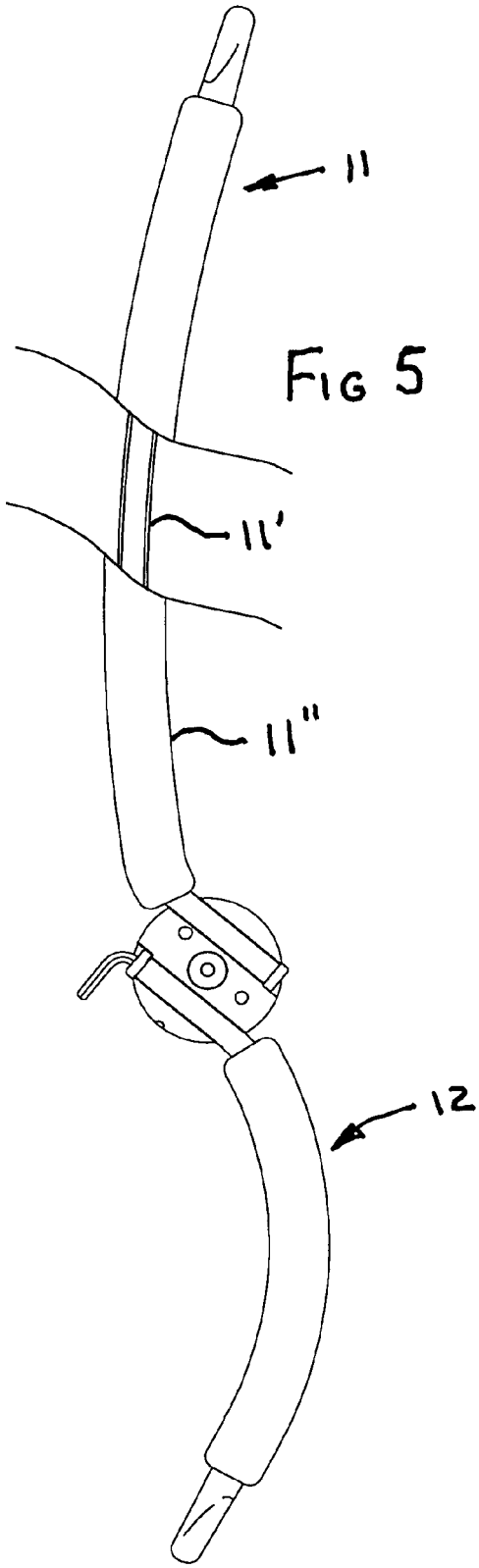
FIG. 5 is a slightly enlarged view of the invented positioning aid not attached to an instrument, shown in its storage configuration and partially broken away, the top half of the hub being removed.

FIG. 5 is a view showing the arms as folded in the storage configuration, with the top half 10B of the hub removed so that the positions of the straight ends 11' and 12' in the transverse holes 23 and 24 can be seen. The arm 11 is also partially sectioned showing its construction. The arm 11 is preferably comprised of a tube 11' (preferably steel or other stiff material) covered by a soft foam tube (or other soft material) 11". Arm 12 is similarly constructed.

Figure 7:
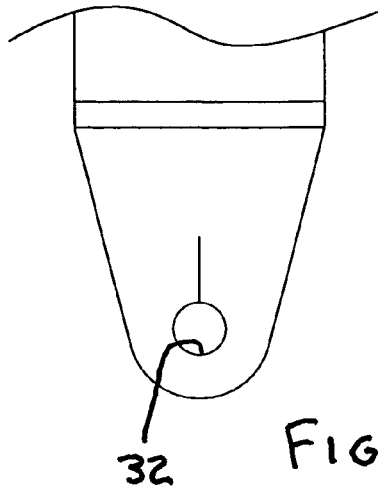
FIG. 7 is an exemplary view of the end of a typical strap that can be used in connection with the invention.
Figure 6:
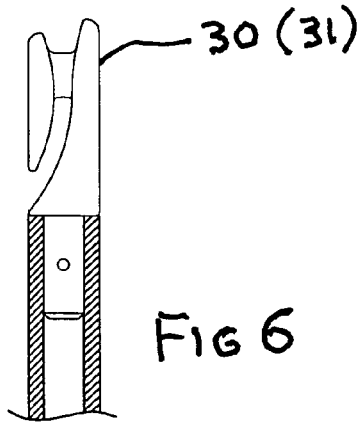
FIG. 6 is a detailed side view of one of the strap hooks on the end of an arm.

The ends of the arms 11 and 12 are each fitted with a hook (30 and 31 as seen in FIG. 6) that is capable of hooking through the holes on the ends of a conventional guitar strap. An end of an illustrative guitar strap, with a hole 32 is shown in FIG. 7.

Figure 9:
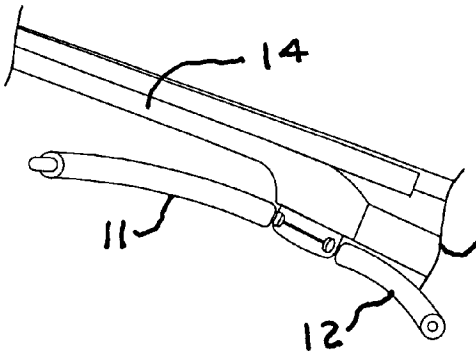
FIG. 9 is a view of the invention in the position shown in FIG. 8, taken in the direction 9-9 of FIG. 8.
Figure 8:
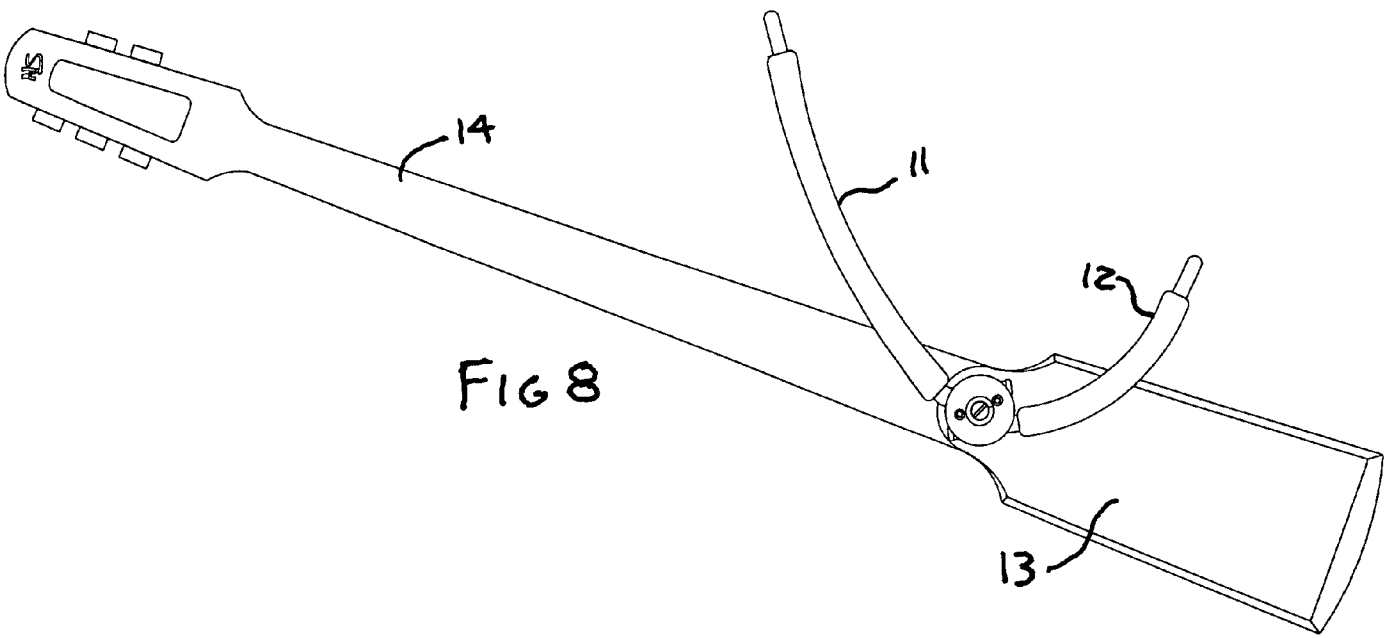
FIG. 8 is a rear view of an instrument (the side of the instrument normally held against the player's body) with the invention attached, with the instrument and the invention shown in one possible position of use.

In use, the arms 11 and 12 are unfolded, as shown in FIGS. 8 and 9. Arm 12 fits partially around the player's waist, while arm 11 extends upward across the player's body toward the shoulder. The strap, (not shown in FIGS. 8 and 9) extends from the end of arm 11, over the player's shoulder, down his or her back, and around the body, attaching to the free end of arm 12. Friction between hub portion 10A and friction thrust washer 26 holds the instrument at whatever angle it is set at. The friction between hub portion 10A and friction thrust washer 26 is preferably set (by adjustment of screw 21) such that it can be relatively easily overcome by the player pushing or pulling on neck 14.

The foregoing description is of one embodiment of the invention, which invention is susceptible of such modifications as may occur to those skilled in the art within the scope of the following claims either literally or by equivalence. Such modifications are intended to be covered by the claims.

I claim:

1. An accessory for a musical instrument of the lute family, said instrument having a body and a neck, said body having a rear surface, which comprises:

a hub rotationally attachable to the rear body surface of said musical instrument, said hub having two bores therein;

a friction element for frictionally restraining rotational motion between said hub and said body; and a pair of curved arms, each of said arms extending into one of said two bores.

2. An accessory for a musical instrument of the lute family as recited in claim 1 wherein said arms are curved so as to approximately fit against the front of a human torso diagonally from about the waist to below the opposite breast.

3. An accessory for a musical instrument of the lute family as recited in claim 1 wherein said arms extending into said bores are a friction fit thereto, the angular position of said arms with respect to said body being adjustable.

4. An accessory for a musical instrument of the lute family as recited in claim 1 wherein the curvature of each of said arms substantially lies in a plane.

5. An accessory for a musical instrument of the lute family as recited in claim 1 wherein said arms are formed from rigid tubes, said arms being covered with soft foam.

6. An accessory for a musical instrument of the lute family as recited in claim 1 and further including a screw holding said hub against said friction element whereby the frictional force resisting the turning of said hub with respect to said body may be adjusted.

7. An accessory for a musical instrument of the lute family as recited in claim 1 wherein said curved arms are rotatable within said bores between a first position whereby said arms are substantially flat against said body of said instrument and a second position wherein said arms curve away from said body to a position whereby said arms can approximately fit against the front of a human torso diagonally from about the waist to below the opposite breast.

* * * * *